US006712722B1

(12) United States Patent
Mosley

(10) Patent No.: US 6,712,722 B1
(45) Date of Patent: Mar. 30, 2004

(54) BASKETBALL SHOT TRAINING DEVICE

(76) Inventor: Gerald Mosley, 228 Bement Ave., Staten Island, NY (US) 10310

( * ) Notice: Subject to any disclaimer, the term of this patent is extended or adjusted under 35 U.S.C. 154(b) by 20 days.

(21) Appl. No.: 10/222,302

(22) Filed: Aug. 16, 2002

Related U.S. Application Data

(63) Continuation-in-part of application No. 09/844,589, filed on Apr. 27, 2001, now abandoned.

(51) Int. Cl.[7] ..... A63B 69/00
(52) U.S. Cl. ..... 473/450; 473/447
(58) Field of Search ..... 473/472, 458, 473/453, 450, 447, 422, 464, 452

(56) References Cited

U.S. PATENT DOCUMENTS 3,820,783 A * 6/1974 Caveness ..... 473/450
3,868,108 A * 2/1975 Kirchner ..... 473/450
4,383,685 A * 5/1983 Bishop ..... 473/450
5,320,342 A * 6/1994 Houck ..... 473/450
6,203,453 B1 * 3/2001 Coddens ..... 473/450
6,283,877 B1 * 9/2001 Cook ..... 473/450
6,461,256 B1 * 10/2002 Popeck ..... 473/450

* cited by examiner

*Primary Examiner*—Paul T. Sewell
*Assistant Examiner*—M. Chambers
(74) *Attorney, Agent, or Firm*—Goldstein & Lavas, P.C.

(57) ABSTRACT

A basketball shot training device including a platform having a lower surface and an upper surface. The lower surface is positionable on a flat recipient surface. The upper surface receives a practicing player's feet thereon in a standing orientation. A tether is provided having a first end and a second end. The first end is adjustably secured to the platform. A glove is coupled with the second end of the tether. The glove has an opening therein for receiving a hand of the practicing player therein. The device is capable of detecting the angle and position of the glove following a shot to ascertain whether a shot was properly executed with the requisite "follow-through".

9 Claims, 5 Drawing Sheets

BASKETBALL SHOT TRAINING DEVICE

CROSS REFERENCES AND RELATED SUBJECT MATTER

This application is a continuation-in-part of patent application Ser. No. 09/844,589, filed in the United States Patent Office on Apr. 27, 2001, now abandoned.

BACKGROUND OF THE INVENTION

The present invention relates to a basketball shot training device and more particularly pertains to teaching and monitoring the proper basketball shooting technique.

Most sports require considerable training to obtain reasonable proficiency. Repetitive training teaches both the muscles and the brain to recreate certain actions needed to play the sport. However, through repetitive training, it is just as likely to reinforce negative habits as positive habits. Thus, training with a coach or instructor is crucial during training to ensure that a sport, or skill related to a sport, is not learned incorrectly.

The use of sports training devices is known in the prior art. Most such sports,training devices help fulfill one of the countless objectives and requirements pertaining to various sports.

By way of example, U.S. Pat. No. 3,581,312 to Nickels discloses a basketball training glove, with a foam member incorporated for preventing a player from using his palm. U.S. Pat. No. 4,881,275 to Cazares discloses a gripping glove.

U.S. Pat. Nos. 6,104,379 to Petrich et al. and 5,982,352 to Pryor disclose various systems which employ computer technology to monitor the movements of the position of a human being.

While these devices fulfill their respective, particular objective and requirements, the aforementioned patents do not describe a basketball shot training device for teaching and monitoring the proper basketball shooting technique and preventing the reinforcement of "bad habits" while training.

The technique followed by the player when shooting the basketball is referred to as "shooting mechanics". Proper shooting mechanics does not ensure a successful shot, but greatly increases the probability of success. However, poor shooting mechanics severely handicap the player. Common poor shooting mechanics include palming the ball, inconsistent hand control, inconsistent wrist control, disproportionate amount of bicep force (compared to the wrist), poor body balance, poor body control, and incorrect release of the ball with the opposite hand.

The improper control of the hand is a major factor in most of these poor shooting mechanics. The hand is the player's directional guide to the basket. Inconsistent motion by the hand creates a lack of player confidence, and prevents the player from repeating a successful shot.

One key element of proper basketball shooting mechanics is the "follow through". The proper follow through can be ascertained by the position of the hand and wrist following the shot. Hand-eye coordination relies upon the wrist for executing distance judgment. Since the wrist is a better regulator of power than the arm, good wrist control creates a softer shot. In particular, the wrist should be angled so that the hand is horizontal and at a certain height relative to the player. Consistently ending a shot with the hand in this position is a major step toward successful basketball shooting, and helps prevent the player from carrying on and reinforcing some of the most common poor shooting mechanics.

Since most of the shot is 'in the wrist', limiting the motion of the arm is similarly important to achieving proper shooting mechanics. It is important the player learns to shoot straight, without moving the arm or elbow across the body.

Further, since basketball requires endurance and discipline, repetitive training is required. However, facilities and weather limitations do not always permit a player to practice as much as necessary. Yet, repetitive basketball training is necessary to instill in the hand and wrist "muscle memory", as well as instill confidence in the player to repeatedly produce the desired results.

In this respect, the basketball shot training device according to the present invention substantially departs from the conventional concepts and designs of the prior art, and in doing so provides an apparatus primarily developed for the purpose of teaching and monitoring the proper basketball shooting technique.

Therefore, it can be appreciated that there exists a continuing need for a new and improved basketball shot training device that can be used for teaching and monitoring the proper basketball shooting technique. In this regard, the present invention substantially fulfills this need.

SUMMARY OF THE INVENTION

In view of the foregoing disadvantages inherent in the known types of sports training devices now present in the prior art, the present invention provides an improved basketball shot training device. As such, the general purpose of the present invention, which will be described subsequently in greater detail, is to provide a new and improved basketball shot training device that has all the advantages of the prior art and none of the disadvantages.

To attain this, the present invention essentially comprises a platform having a generally rectangular configuration. The platform has a lower surface and an upper surface. The lower surface is positionable on a flat recipient surface. The upper surface receives a practicing player's feet thereon in a standing orientation, and has a rear inclined portion for positioning the player's feet. A tether is provided having a first end and a second end. The first end is adjustably and releasably secured to the platform. A glove is coupled with the second end of the tether. The glove has an opening therein for receiving a hand of the practicing player therein. An optical sensor is coupled with respect to the glove responsive to alignment with a light beam emanating from the platform. A rangefinder detects the height of the glove above the base. The training device has a control unit which is programmed to monitor a proper shooting motion of the hand of the practicing player when positioned within the glove according to the final height and angle of the glove immediately following an attempted shot. A display is coupled with respect to the control unit to indicate results of the training.

It is an object of the invention to provide a training device which measures the proper follow-through of the player's shooting hand during a shot. Accordingly, the player wears a glove while shooting or simulating shooting a basket. The glove is cooperatively linked to the platform, such that the player is alerted when a proper shot has been achieved by determining whether the hand finishes the shot in a horizontal position at a predetermined height.

It is yet another object of the invention to train a player to stand on the balls of his/her feet while shooting a basket. Accordingly, the platform rear is inclined to teach the player to stand correctly while shooting.

It is a further object of the invention to help a player execute the shot mainly with the wrist and to prevent improper movement of the arm and elbow. Accordingly, the glove is linked to the base by a tether, which prevents stray movement of the arm across the body when shooting, and limits motion of the arm and elbow so that the player is forced to use the wrist.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved basketball shot training device that has all the advantages of the prior art sports training devices and none of the disadvantages.

It is another object of the present invention to provide a new and improved basketball shot training device that may be easily and efficiently manufactured and marketed.

It is a further object of the present invention to provide a new and improved basketball shot training device that is of durable and reliable construction.

An even further object of the present invention is to provide a new and improved basketball shot training device that is adaptable to different players. Accordingly, the predetermined height of proper follow-through may be adjusted according to the particular player using the device, and the system may be readily adapted to both left and right handed players.

Even still another object of the present invention is to provide a new and improved basketball shot training device for teaching and monitoring the proper basketball shooting technique.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference numerals refer to the similar elements of the invention throughout the various drawing figures.

DESCRIPTION OF THE PREFERRED EMBODIMENT

Figure 1:
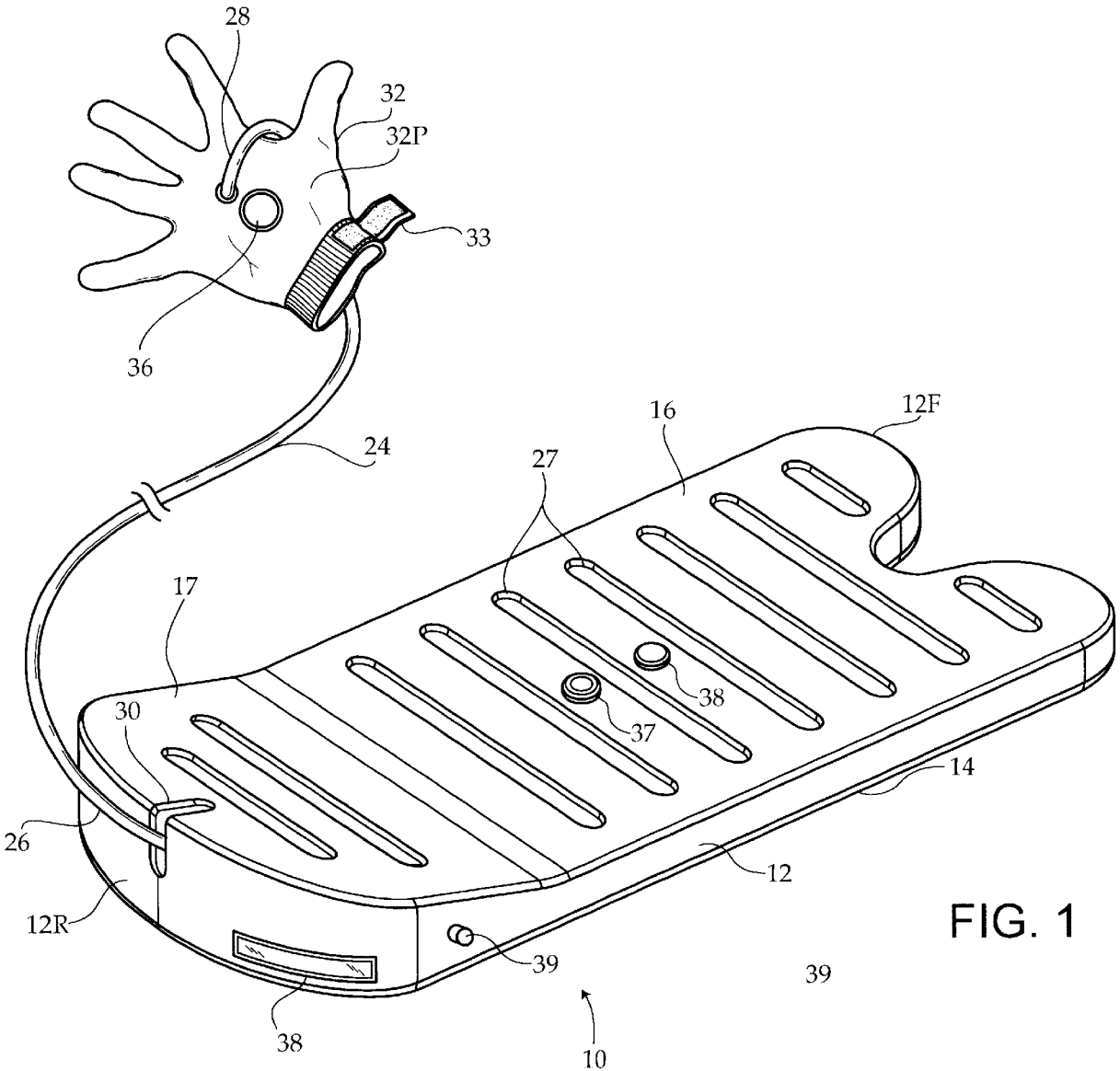
FIG. 1 is a perspective view of the preferred embodiment of the basketball shot training device constructed in accordance with the principles of the present invention, showing the glove tethered to the platform thereof.
Figure 2:
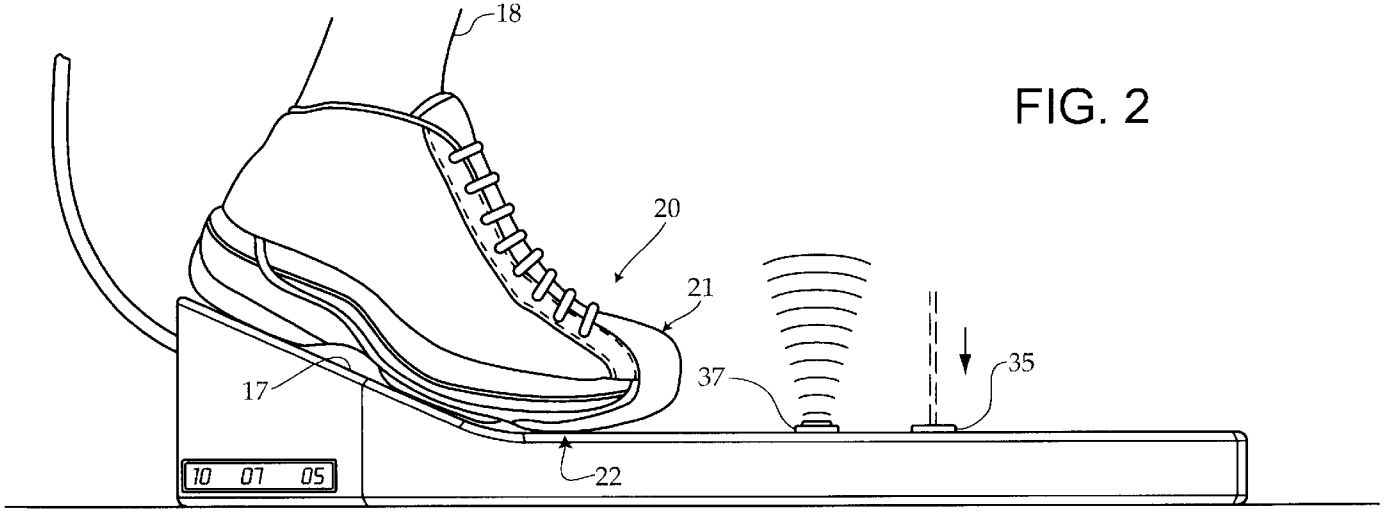
FIG. 2 is a side elevational view of the invention, with a player standing upon the rear inclined portion of the upper surface, and wherein a ultrasonic range finder and light source are being used to ascertain the height and angle of the glove.
Figure 3:
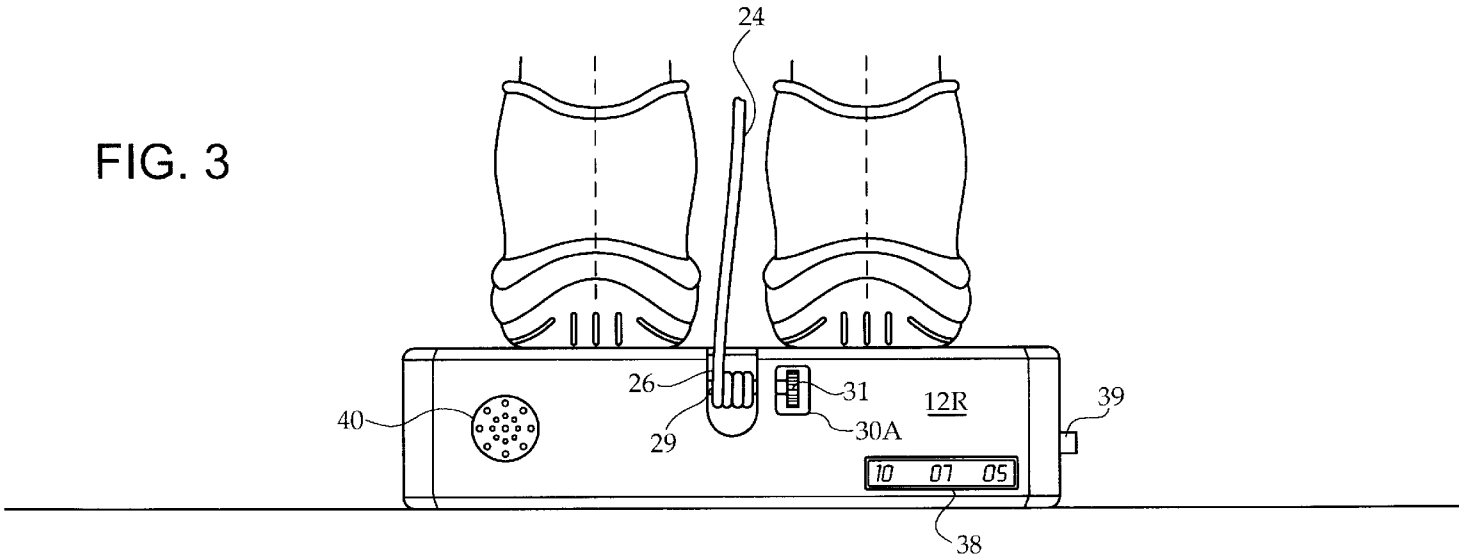
FIG. 3 is rear elevational view of the present invention, illustrating an annunciator, and the adjustable and removable attachment of the tether to the platform.

With reference now to the drawings, and in particular, to FIGS. 1 through 6 thereof, the preferred embodiment of the new and improved basketball shot training device embodying the principles and concepts of the present invention and generally designated by the reference number 10 will be described.

Specifically, it will be noted in the various figures that the device relates to a basketball shot training device for teaching and monitoring the proper basketball shooting technique. In a broad sense, the device comprises a platform, a tether, a glove, a sensing system, and a feedback system. Such components are individually configured and correlated with respect to each other so as to attain the desired objective.

The platform 12 has a generally rectangular configuration. The platform 12 has a lower surface 14 and an upper surface 16, a front 12F and a rear 12R. The lower surface 14 is positionable on any flat recipient surface. The upper surface 16 receives a practicing player's 18 feet 20 thereon in a standing orientation. Note FIG. 2. In particular, the feet 20 have toes 21 and a ball portion 22 just rearward of its toes 21. The upper surface 16 has an inclined rear portion 17 which causes the practicing player 18 to lean toward his/her toes and balance upon the ball portions 22 of his/her feet 20. The upper surface 16 could also be provided with grooves 22 or the like that will allow the player 18 to comfortably stand thereon.

The tether 24 has a first end 26 and a second end 28. The first end 26 is adjustably secured to the platform 12 so that it can extend upward therefrom, preferably alongside or behind the player. Accordingly, the first end 26 of the tether preferably extends from the rear 12R of the platform. The upper surface 16 of the platform 12 is provided with a primary recess 30 therein for allowing the first end 26 to extend from the upper surface 16 immediately behind the player 18 when standing thereupon. The primary recess 30 can also house an attachment pin 29, extending transversely therein for securing the tether 24. In particular, a secondary recess 30A may be provided immediately adjacent to the primary recess 30 to allow the pin to be removed or displaced to allow removal of the first end 26 of the tether 24. Removal of the tether 24 allows the glove and tether combination to be used separately from the platform. In particular, the first end can be secured to a belt extending around the waist of a player, allowing the player to conduct alternate training exercises. In addition, an adjustment wheel 31 may be provided on the pin 29 to allow the tether 24 to be easily lengthened and shortened as needed.

Figure 4:
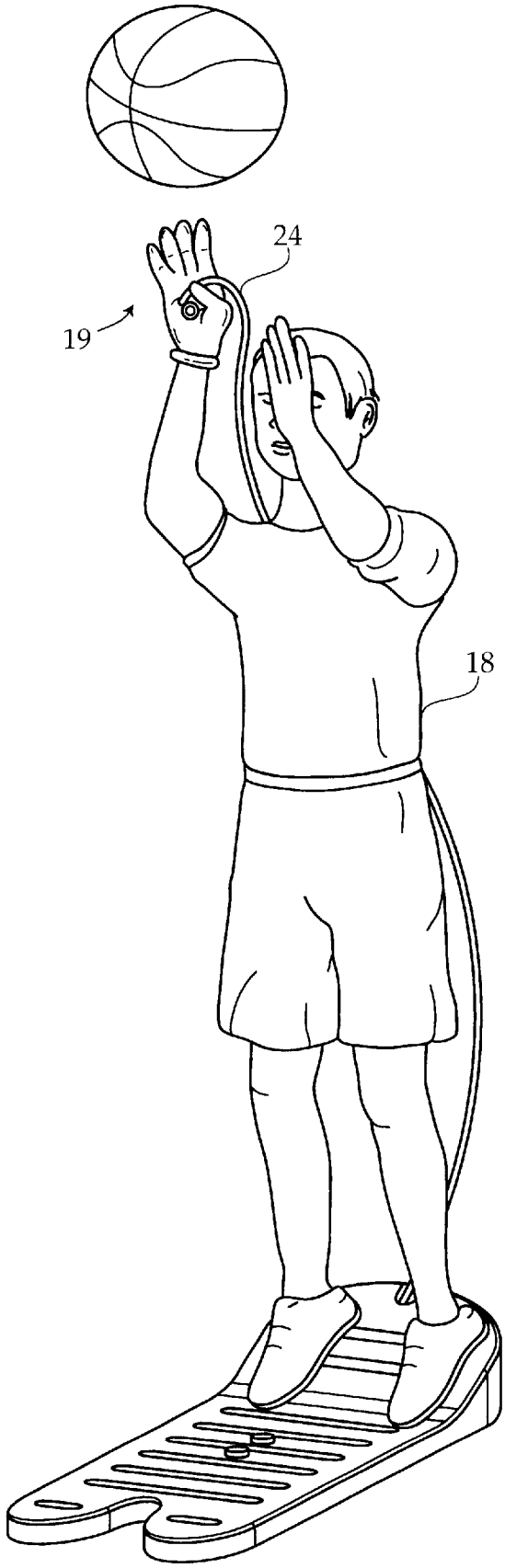
FIG. 4 is a perspective view illustrating the invention in use, wherein a player is taking a shot while standing on the platform and while his shooting hand is within the glove tethered to said platform.

The glove 32 is coupled with the second end 28 of the tether 24 and has an opening for receiving a shooting hand 19 of the practicing player 20 therein. Accordingly, by virtue of its attachment between the glove 32 and the platform 12, the tether 24 restricts motion of the arm, prevents undesirable movement of the elbow or arm across the body, and further encourages the player to use the wrist to control the shot. As shown in FIG. 4, the glove 32 is positionable on the hand of the practicing player 18 so as to facilitate the player holding a basketball 34 in a proper position. A fastening strap 33 facilitates securement of the glove 32 on the shooting hand 19 of the player 18.

The glove 32 has a standard five finger configuration, may be left or right handed, and has a palm portion 32P, such that the second end 28 of the tether 24 is secured at the palm portion 32P. In addition, an optical sensor 36 is provided on the palm portion 32P. The optical sensor 36 cooperates with a light emitter 35 on the upper surface 16 of the platform 12, such that the optical sensor 36 is capable of detecting light from the light emitter 37 and responding thereto. The platform 12 also has an ultrasonic rangefinder 37 which is capable of detecting the height of the glove 32. Further, a display 38 allows the player and a coach to monitor status of the device, and a calibration control 39 allows a predetermined height to be set by the coach, at which proper follow-through is ascertained. An annunciator 40 is provided to provide an audible alert to the player and/or coach, and will generally indicate that the shot has been properly executed. However, the annunciator may be configured to provide distinct tones to indicate that a shot has been incorrectly executed, or that the hand is at the incorrect height or angle.

Figure 6:
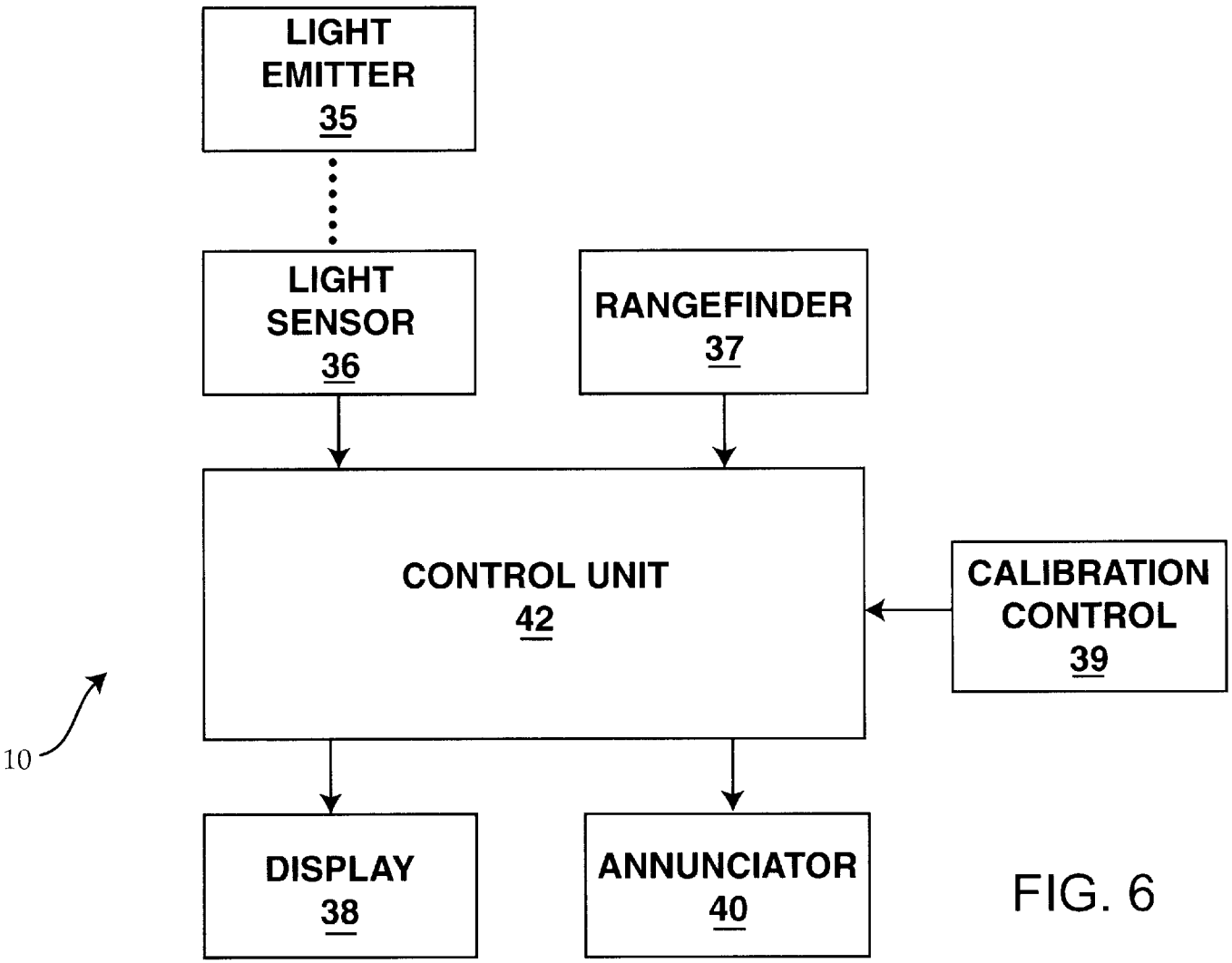
FIG. 6 is a block diagram, illustrating the functional interconnection of various components of the invention.

Referring to FIG. 6, the device 10 has a control unit 42 that facilitates that functionality of the basketball training device as described. In particular, the control unit is connected to both the optical sensor 36 and rangefinder 37 to receive data therefrom. Accordingly, the optical sensor 36 indicates to the control unit when light from the light emitter 35 has been detected. In addition, the rangefinder 37 indicates to the control unit the detected height of the glove thereabove. The calibration control 39 is connected to the control unit to allow the predetermined height to be selected by the user or coach. The display 38 and annunciator 40 allow the control unit to communicate with the user and coach the successes and failures of the player in attempting to execute a proper shot. Accordingly, the display can indicate statistics regarding the player's successfully executed shots, unsuccessfully executed shots, shot where the glove finished at the proper height only, and shots where the hand finished at the proper angle only. Thus, the display can be configured to display information in numerous fashions. In a similar regard, the annunciator can alert when a shot is successfully executed, such that the predetermined height is detected by the rangefinder and the proper angle is detected by the sensor. The annunciator can similarly be configured to provide distinctive tones to report success or failure.

In this regard, the device is preferably configured so that at least in one mode, the annunciator indicates a steady tone when the glove is properly positioned. Accordingly, the coach can adjust the length of the tether to accommodate the player, can position the glove in it's proper position, and then manipulate the calibration control 39 until a steady tone is achieved. In this manner the predetermined height can be set.

In order to be sensitive to the angle of the glove, the light emitter 37 must produce light in a narrow dispersion pattern, and/or the optical sensor 36 must receive light through a narrow sensitivity pattern. Accordingly, a low level diode LASER is preferable for the emitter. As illustrated, the light emitter 37 is present in the platform and the optical sensor 36 is present in the glove. Such would seem to be a preferred arrangement since the reverse would allow light to travel in all directions as the player moves the gloved hand through various positions. However, the preferred arrangement requires telemetry between the optical sensor 36 in the glove and the control unit 42 in the platform, while avoiding a less preferable connection within the tether. Such telemetry can be accomplished in numerous ways, including RF communication and an omni directional IR link, as would be appreciated by those skilled in the art. Also, to ascertain whether and when shots are attempted, in order to determine unsuccessful shots, and the moment when the attempted shot is completed, a sensor can be provided in communication with the tether 24 to detect when the tether 24 is 'jerked' or tensioned—when a shot is attempted. Similarly, such a sensing mechanism can be provided in numerous ways, as would be appreciated by those skilled in the art.

Figure 5:
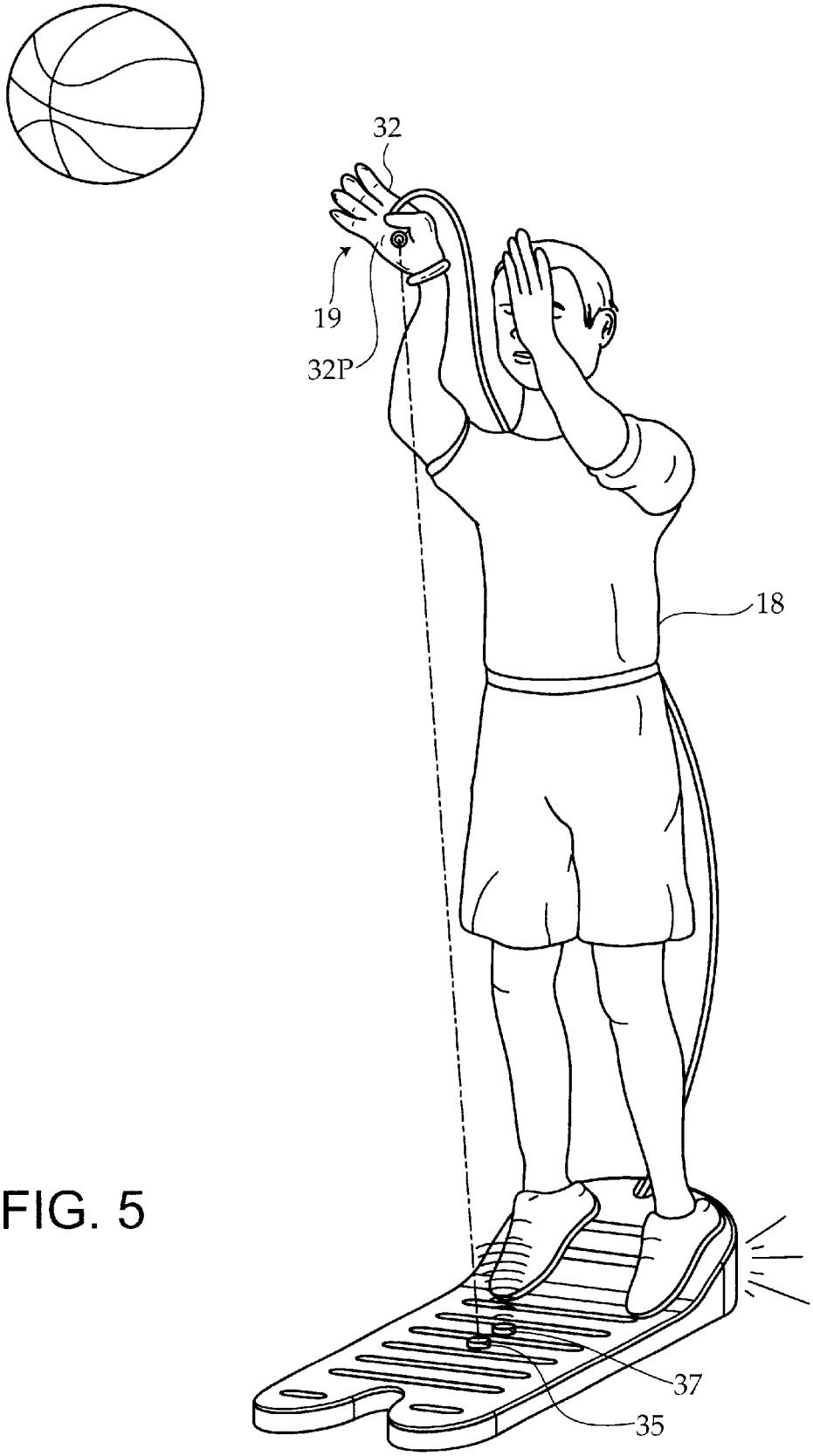
FIG. 5 is a perspective view similar to FIG. 4, except illustrating a moment later during the shot than FIG. 4.

Accordingly, as indicated by FIG. 4 and FIG. 5, the basketball training device 10 is shown in use, wherein a player is attempting to carry out a shot while standing on the platform 12 and wearing the glove 32. When the glove 32 is donned, the tether 24 extends behind the player, over the arm (preferably over the bicep), extends between the thumb and forefinger, and is attached to the palm of the glove 32. As indicated, the player's shooting hand 19, and the glove 32 is positioned substantially vertically. Accordingly, the optical sensor 36 would not detect light produced by the light emitter 37. Thus, when a successfully indicated shot is not communicated to the player by the device 10, the player will reassess his shooting technique and hopefully "level off" the hand at the end of the shot; so that the light sensor 36 will detect light from the light emitter 35 and the player will hopefully position the hand at the proper height such that the rangefinder 35 will detect the same and communicate that the shot was successfully executed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A basketball shot training device for teaching and monitoring the proper basketball shooting technique comprising, in combination:

a platform having a lower surface and an upper surface, the lower surface being positionable on a flat recipient surface, the upper surface receiving a practicing player's feet thereon in a standing orientation;

a glove having an opening for receiving a shooting hand of the practicing player therein;

a sensor coupled with respect to the glove, the sensor for detecting a proper shooting position the glove; and a mechanism for indicating to the player that the glove has achieved a desired position above the platform.

2. The basketball shot training device as recited in claim 1, further comprising a tether having a first end and a second end, the first end secured to the platform, the second end secured to the glove.

3. The basketball shot training device as recited in claim 1, wherein the proper shooting position includes a proper angle and a predetermined height, such that the predetermined height is adjustable by the player.

4. The basketball shot training device as recited in claim 3, wherein the sensor includes an optical sensor and a rangefinder, the optical sensor for detecting the proper angle of the glove with respect to the base, the rangefinder for determining whether the glove is at the predetermined height above the platform.

5. The basketball shot training device as recited in claim 4, further comprising a light emitter located in the upper surface of the base and oriented to emit light upward therefrom, wherein the rangefinder is located on the upper surface of the base, and the optical sensor is located in the glove.

6. The basketball shot training device as recited in claim 5, further comprising an annunciator which emits a tone when the proper angle and predetermined height are detected by the rangefinder and optical sensor, and a calibration control which adjusts the predetermined height.

7. The basketball shot training device as recited in claim 6, wherein the player has feet having a forward portion, and wherein the platform upper surface has a rear inclined portion which forces the player to stand on the forward portions of the player's feet.

8. The basketball shot training device as recited in claim 7, wherein the glove has a palm, a forefinger, and a thumb, and wherein the second end of the tether extends between the thumb and forefinger of the glove before attaching to the palm.

9. The basketball shot training device as recited in claim 8, further comprising a display for communicating the success of the player in achieving properly executed shot.

* * * * *